US005951788A

United States Patent [19]

Holmberg

[11] Patent Number: 5,951,788

[45] Date of Patent: Sep. 14, 1999

[54] SUPERCONDUCTING HIGH STRENGTH STAINLESS STEEL MAGNETIC COMPONENT

[75] Inventor: Håkan Holmberg, Gävle, Sweden

[73] Assignee: Sandvik AB, Sandviken, Sweden

[21] Appl. No.: 08/904,456

[22] Filed: Aug. 1, 1997

Related U.S. Application Data

[63] Continuation of application No. 08/552,050, Nov. 2, 1995, abandoned.

[30] Foreign Application Priority Data

Nov. 2, 1994 [SE] Sweden ..... 9403749

[51] Int. Cl.[6] ..... C22C 38/38

[52] U.S. Cl. ..... 148/307; 148/310; 148/111; 148/112; 148/113

[58] Field of Search ..... 420/44, 56, 59; 148/327, 307, 310, 111, 112, 113

[56] References Cited

U.S. PATENT DOCUMENTS 4,285,725 8/1981 Gysel et al. ..... 148/327

FOREIGN PATENT DOCUMENTS 47-35642 9/1972 Japan ..... 420/56
56-158851 12/1981 Japan ..... 420/56
9000674 4/1992 Sweden .

OTHER PUBLICATIONS

S. Sgobba et al., "Cryogenic Properties of Special Welded Stainless Steels for the Beam Screen of the Large Hadron Collider", presented at the 4th European Conference on Advanced Materials and Processes EUROMAT 95, Venice–Padua, Italy, Sep. 25–28, 1995.

*Primary Examiner*—Deborah Yee
*Attorney, Agent, or Firm*—Burns, Doane, Swecker & Mathis, L.L.P.

[57] ABSTRACT

A stainless steel alloy useful as a construction material in superconducting magnetic components, said alloy containing in weight percent 0.05–0.25% C, 0.1–1.5% Si, 3.5–7.5% Mn, 17–21% Cr, 6–10% Ni, 0.10–0.50% N, the remainder being Fe and normal impurities.

9 Claims, No Drawings

SUPERCONDUCTING HIGH STRENGTH STAINLESS STEEL MAGNETIC COMPONENT

This application is a continuation of application Ser. No. 08/552,050, filed Nov. 2, 1995, now abandoned.

BACKGROUND OF THE INVENTION

The present invention relates to a non-magnetic stainless steel and its use in the manufacture of superconducting magnet components such as magnet collars used in particle accelerator apparatuses.

The rapid development of research within various advanced physical laboratories has created an increased demand for more sophisticated materials with combinations of properties not previously considered or easily achievable such as, for example, the combination of high mechanical strength and a non-magnetic structure for materials to be used in applications where the material is required to be magnetically inert also at low temperatures.

Among high strength steels, the so-called non-stable austenitic spring steels, SS2331 with a typical nominal analysis of 17 Cr, 7, Ni, 0.8 Si, 1.2 Mn, 0.1 C and 0.03 N are especially valuable because of their combination of high strength and good corrosion properties.

OBJECTS AND SUMMARY OF THE INVENTION

It is an object of this invention to avoid or alleviate the problems of the prior art.

It is further an object of this invention to provide a non-magnetic high strength stainless steel which can be used for the manufacture of superconducting magnet components.

In one aspect of the invention there is provided a high strength, non-magnetic, stainless steel alloy useful in the manufacture of superconducting magnet components having low magnetic permeability and good thermal contraction values at low temperatures and consisting essentially of, in percent by weight:

C: 0.05–0.25

Si: 0.1–1.5

Mn: 3.5–7.5

Cr: 17–21

Ni: 6–10

N: 0.10–0.50 the remainder being Fe and normal impurities.

In another aspect of the invention, there is provided a superconducting magnet component, the improvement comprising making the component of an alloy consisting essentially of:

C: 0.05–0.25

Si: 0.1–1.5

Mn: 3.5–7.5

Cr: 17–21

Ni: 6–10

N: 0.10–0.50 the remainder being Fe and normal impurities.

DETAILED DESCRIPTION OF THE PREFERRED EMBODIMENTS OF THE INVENTION

Thanks to a systematic development work, it has now been found that it is possible, by a carefully selected composition, to achieve by cold working, a specific deformation hardening effect while preserving a non-magnetic structure. In addition, it has been found possible without affecting the magnetic properties, to provide precipitation hardening of the alloy such that a very high strength combined with low magnetic permeability and good thermal contraction values is achieved at very low temperatures.

The optimized composition (in weight—%) of the alloy of the present invention in its broadest aspect is as follows:

C: 0.05–0.25

Si: 0.1–1.5

Mn: 3.5–7.5

Cr: 17–21

Ni: 6–10

N: 0.10–0.50 the remainder being Fe and normal impurities

Cr content should be high in order to achieve good corrosion resistance. The alloy can, to advantage, be annealed and precipitate high chromium-containing nitrides. In order to reduce the tendency for excessive local reduction of Cr content with the non-stabilization of the austenite phase and reduction in corrosion resistance, the Cr content should be at least 17, preferably at least 18%. Since Cr is a ferrite stabilizing element, the presence of very high Cr contents can lead to the presence of ferromagnetic ferrite. The Cr content should therefore be no more than 21%, preferably no more than 19%.

Ni is a very efficient austenite stabilizing element. Ni also increases austenite stability against deformation into martensite. In order to achieve a sufficiently stable non-magnetic structure, the Ni content should be at least 6% and preferably be at least 7%. In order to achieve high strength after cold working, the Ni content should not exceed 10%.

Mn has besides an austenite stabilizing effect, the important ability of providing solubility of nitrogen, both in melted and solid phases. The Mn content should therefore be at least 3.5%. High amounts of Mn, however, reduce the corrosion resistance in chloride-containing environments and should therefore not exceed 7.5%.

The amounts of the various components of the alloy should be selected such that the nickel equivalent calculated as Ni-equiv=Ni+30 C+0.5 Mn+25 N, and the chromium equivalent calculated as Cr-equiv=Cr+Mo+1.5 Si both amount to values in the range of 16–22, preferably 18–20.

The invention is additionally illustrated in connection with the following Example which is to be considered as illustrative of the present invention. It should be understood, however, that the invention is not limited to the specific details of the Example.

EXAMPLE

Production of the testing materials included melting in a high-frequency induction furnace and casting to ingots at about 1600° C. These ingots were heated to about 1200° C. and hot worked by forging the material into bars. The materials were then subjected to hot rolling into strips which thereafter were quench annealed and clean pickled. The quench anneal was carried out at about 1080° C. and quenching occurred in water.

The strips obtained after quench annealing were then cold rolled to various amounts of reduction after which test samples were taken out for various tests. In order to avoid variations in temperature and their possible impact on magnetic properties, the samples were cooled to room temperature after each cold rolling step.

TABLE 1

Chemical Analysis, in weight-%, of testing material

| Steel No. | C | Si | Mn | Cr | Ni | Mo | Al | N |
|---|---|---|---|---|---|---|---|---|
| 869* | 0.11 | 0.69 | 4.29 | 18.52 | 7.12 | — | — | 0.27 |
| 880* | 0.052 | 0.89 | 3.82 | 20.25 | 10.01 | — | — | 0.29 |
| 866** | 0.11 | 0.83 | 1.49 | 18.79 | 9.47 | — | — | 0.20 |
| AISI** 304 | 0.034 | 0.59 | 1.35 | 18.56 | 9.50 | — | — | 0.17 |
| AISI** 305 | 0.042 | 0.42 | 1.72 | 18.44 | 11.54 | — | — | 0.036 |

P,S <0.030 weight-% is valid for all alloys above.
*alloys of the invention
**comparison samples The strength of the alloys when subjected to uniaxial tensile testing as function of cold working degree appears from Table 2, where $R_p$ 0.05 and $R_p$ 0.2 correspond to the load that gives 0.05% and 0.2% remaining elongation, and where $R_m$ corresponds with the maximum load value in the load elongation diagram and where A10 corresponds with ultimate elongation.

TABLE 2

Yield point, tensile strength and elongation of testing materials

| Steel No. | Condition | $R_p$ 0.05 MPa | $R_p$ 0.2 MPa | Rm MPa | A10 |
|---|---|---|---|---|---|
| 869* | 35% reduction | 792 | 1062 | 1203 | 9 |
| | 50% reduction | 1007 | 1311 | 1464 | 6 |
| | 75% reduction | 1082 | 1434 | 1638 | 4 |
| 880* | 35% reduction | 836 | 1086 | 1208 | 7 |
| | 50% reduction | 1025 | 1288 | 1410 | 5 |
| | 75% reduction | 985 | 1343 | 1566 | 4 |
| 866** | 35% reduction | 796 | 1036 | 1151 | 8 |
| | 50% reduction | 986 | 1239 | 1366 | 5 |
| | 75% reduction | 997 | 1356 | 1558 | 4 |
| AISI** 304 | 35% reduction | 683 | 912 | 1080 | 9 |
| | 50% reduction | 841 | 1127 | 1301 | 6 |
| | 75% reduction | 910 | 1300 | 1526 | 5 |
| AISI** 305 | 35% reduction | 555 | 701 | 791 | 15 |
| | 50% reduction | 841 | 1042 | 1139 | 6 |
| | 75% reduction | 868 | 1177 | 1338 | 5 |

*alloys of the invention
**comparison samples

Table 2 shows that with alloys of the invention, very high strength levels can be obtained at cold working. AISI 305 appears to show a substantially slower work hardening due to its low contents of dissolved alloy elements, i.e., nitrogen and carbon, combined with rather high nickel content.

For a material according to this invention, there is the requirement that this material, while exhibiting high strength, also has a low magnetic permeability as possible, i.e., close to 1.

Table 3 shows the magnetic permeability depending upon field strength for the various alloys after 75% cold reduction and annealing at 450° C./2h.

TABLE 3

Permeability values of test alloys. Underlined values indicate maximal measured permeability. The value at the bottom indicates tensile strength in the corresponding condition.

| Field Strength Oersted | Steel No. 869* | 880* | 866** | AISI 304** | AISI 305** |
|---|---|---|---|---|---|
| 25 | 1.0350 | — | — | — | — |
| 50 | 1.0389 | 1.0099 | 1.0346 | 1.5231 | 1.0593 |
| 100 | 1.0372 | 1.0118 | 1.0248 | 1.8930 | 1.0666 |
| 150 | 1.0359 | 1.0115 | 1.0413 | 2.1056 | 1.0688 |
| 200 | 1.0350 | 1.0110 | 1.0505 | 2.2136 | 1.0729 |
| 300 | 1.0329 | 1.0099 | 1.0640 | 2.2258 | 1.0803 |
| 400 | 1.0322 | 1.0089 | 1.0754 | 2.1506 | 1.0855 |
| 500 | 1.0321 | 1.0081 | 1.0843 | 2.0601 | 1.0884 |
| 700 | — | 1.0071 | 1.0917 | — | 1.0859 |
| 1000 | — | — | 1.0882 | — | — |
| ==== | ==== | ==== | ==== | ==== | ==== |
| Rm MPa | 1840 | 1740 | 1720 | 1644 | 1380 |

*alloys of the invention
**comparison strength

Table 3 shows that with alloys of this invention it is possible by coldworking and precipitation hardening, to achieve high strength exceeding 1700 or even 1800 MPa combined with very low values of the magnetic permeability <1.05. The reference alloys with compositions outside to scope of this invention and the reference steels AISI 304 and AISI 305 appear to be too unstable in austenite, or appear to have an insufficient degree of work hardening.

As appears from the results in Table 4, it is impossible with alloys of this invention, by cold working and precipitation hardening, to achieve a strength exceeding 1700 MPa combined with very low values of the magnetic permeability of <1.05. The reference steels AISI 304 and AISI 305 appear to be too unstable in austenite, and alloys 866 and AISI 304 appear to be magnetic at high strength or appear to have an insufficient degree of work hardening.

As a further result of such material having low values of magnetic permeability, it was found that such material also possesses a desirable degree of thermal contraction value at low temperatures. Conducted measurements have shown that integrated thermal contraction for a temperature range 77 K–300 K is about 0.25%.

Further, for the material in the annealed or slightly cold rolled conditions (tensile strength ~1000 N/mm$^2$) the relative magnetic permeability coefficient has been measured to value below 1.005 for temperatures down to 4.2 K or even 1.8 K.

Measurements have been carried out on a material with the following analysis given in weight—%:

| C | Si | Mn | Cr | Ni | N |
|---|---|---|---|---|---|
| 0.11 | 0.8 | 6.0 | 18.5 | 7.2 | 0.25 |

the remainder being Fe and normal impurities.

TABLE 4

| Condition | Temp. K | $R_p$ 0.2 | Rm | |
|---|---|---|---|---|
| Annealed | 293 | 475 | 850 | N/mm$^2$ |
| Annealed | 77 | 1090 | 1620 | N/mm$^2$ |

TABLE 4-continued

| Condition | Temp. K | $R_p$ 0.2 | Rm | |
|---|---|---|---|---|
| Cold Rolled | 293 | 1375 | 1630 | $N/mm^2$ |
| Cold Rolled | 77 | 1820 | 2385 | $N/mm^2$ |

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. Superconducting magnet components made of an alloy consisting essentially of, in percent by weight:

C: 0.05–0.25

Si: 0.1–1.5

Mn: 3.5–7.5

Cr: 17–21

Ni: 6–10

N: 0.10–0.50 the remainder being Fe and normal impurities, the alloy in the annealed or slightly cold rolled conditions having a relative magnetic permeability coefficient below 1.005 for temperatures down to 4.2 K.

2. A superconducting magnetic component of claim 1 wherein the alloy contains 17–19% Cr and 7–10% Ni.

3. A superconducting magnetic component of claim 1 wherein the contents of the alloying elements are so adjusted that the following conditions are fulfilled:

Cr-equiv=Cr+Mo+1.15 Si=16–22

Ni-equiv=Ni+30 C+0.5 Mn+25 N=16–22.

4. A superconducting magnetic component of claim 3 wherein the contents of the alloying elements are so adjusted that the following conditions are fulfilled:

Cr-equiv=Cr+Mo+1.15 Si=18–20

Ni-equiv=Ni+30 C+0.5 Mn+25 N=18–20.

5. A superconducting magnetic component of claim 1, wherein said component comprises a superconducting magnet collar.

6. A method of using a stainless steel alloy, said alloy consisting essentially of, in percent by weight:

C: 0.05–0.25;

Si: 0.1–1.5;

Mn: 3.5–7.5;

Cr: 17–21;

Ni: 6–10; and

N: 0.10–0.50;

wherein said method comprises:

subjecting said alloy to a treatment comprising at least one of annealing and cold rolling; and fabricating a superconducting magnet component from said alloy;

whereby said component is imparted with a relative magnetic permeability coefficient below 1.005 for temperatures down to 4.2 K.

7. The method of claim 6, further comprising fabricating a superconducting magnet collar from said alloy.

8. A method of making a superconducting magnet component, said method comprises:

formulating a stainless steel alloy having a composition consisting essentially of, in percent by weight:

C: 0.05–0.25;

Si: 0.1–1.5;

Mn: 3.5–7.5;

Cr: 17–21;

Ni: 6–10; and

N: 0.10–0.50;

treating said alloy by at least one of annealing and cold rolling; and shaping said alloy into said superconducting magnet component;

whereby said component is imparted with a relative magnetic permeability coefficient below 1.005 for temperatures down to 4.2 K.

9. The method of claim 8, wherein said method further comprises shaping said alloy into a superconducting magnet collar.

* * * * *